US011239536B2

(12) United States Patent
Zheng et al.

(10) Patent No.: US 11,239,536 B2
(45) Date of Patent: Feb. 1, 2022

(54) COUPLING STRUCTURE OF FILTER AND PROCESSING METHOD

(71) Applicant: HUAWEI TECHNOLOGIES CO., LTD., Guangdong (CN)

(72) Inventors: Qingkuo Zheng, Xi'an (CN); Shibo Wu, Xi'an (CN); Shouyou Li, Xi'an (CN); Chen Zhong, Xi'an (CN)

(73) Assignee: Huawei Technologies Co., Ltd., Guangdong (CN)

( * ) Notice: Subject to any disclaimer, the term of this patent is extended or adjusted under 35 U.S.C. 154(b) by 0 days.

(21) Appl. No.: 17/103,466

(22) Filed: Nov. 24, 2020

(65) Prior Publication Data

US 2021/0083354 A1 Mar. 18, 2021

Related U.S. Application Data

(63) Continuation of application No. PCT/CN2019/081912, filed on Apr. 9, 2019.

(30) Foreign Application Priority Data

May 29, 2018 (CN) ..... 201810533082.4

(51) Int. Cl.
*H01P 1/208* (2006.01)
*H01P 5/02* (2006.01)
(Continued)

(52) U.S. Cl.
CPC ..... *H01P 1/208* (2013.01); *H01P 1/2053* (2013.01); *H01P 5/02* (2013.01); *H01P 7/06* (2013.01); *H01P 11/007* (2013.01)

(58) Field of Classification Search
CPC ..... H01P 1/208; H01P 1/2082; H01P 1/2084; H01P 1/2086; H01P 1/20; H01P 1/202;
(Continued)

(56) References Cited

U.S. PATENT DOCUMENTS 6,559,740 B1 5/2003 Schulz et al.
2004/0227593 A1 11/2004 Carpintero et al.
(Continued)

FOREIGN PATENT DOCUMENTS

CN 2879537 Y 3/2007
CN 201838698 U 5/2011
(Continued)

OTHER PUBLICATIONS

Office Action issued in Chinese Application No. 201810533082.4 dated Jul. 3, 2020, 8 pages.
(Continued)

*Primary Examiner* — Stephen E. Jones
(74) *Attorney, Agent, or Firm* — Fish & Richardson P.C.

(57) ABSTRACT

The present disclosure relates to a coupling structure of a filter. One example coupling structure of the filter includes at least two resonant cavities. Each resonant cavity includes an internal space surrounded by a resonant cavity wall, a resonant cavity bottom plate, and a resonant cavity lid. The at least two resonant cavities are sequentially connected. Each resonant cavity of the at least two resonant cavities includes one resonator. A coupling rib assembly is between every two resonant cavities of the at least two resonant cavities. The coupling rib assembly includes a first coupling rib and a second coupling rib, where the first coupling rib is connected to the resonant cavity wall and the resonant cavity bottom plate to block two adjacent resonant cavities from each other, and the second coupling rib is connected to the resonant cavity bottom plate and intersects with the first coupling rib.

9 Claims, 5 Drawing Sheets

(51) Int. Cl.
*H01P 7/06* (2006.01)
*H01P 11/00* (2006.01)
*H01P 1/205* (2006.01)

(58) Field of Classification Search
CPC .. H01P 1/2053; H01P 5/02; H01P 7/06; H01P 11/007
See application file for complete search history.

(56) References Cited

U.S. PATENT DOCUMENTS

| | | | | |
|---|---|---|---|---|
| 2008/0007371 | A1 | 1/2008 | Rottmoser et al. | |
| 2010/0090785 | A1 | 4/2010 | Panariello et al. | |
| 2016/0072169 | A1 | 3/2016 | Lin et al. | |
| 2018/0277918 | A1* | 9/2018 | Kim | H01P 5/024 |

FOREIGN PATENT DOCUMENTS

| | | | |
|---|---|---|---|
| CN | 102122742 | A | 7/2011 |
| CN | 102637933 | A | 8/2012 |
| CN | 102931466 | A | 2/2013 |
| CN | 202839912 | U | 3/2013 |
| CN | 103066354 | A | 4/2013 |
| CN | 203277601 | U | 11/2013 |
| CN | 103490128 | A | 1/2014 |
| CN | 205921058 | U | 2/2017 |
| CN | 206098631 | U | 4/2017 |
| CN | 206322826 | U | 7/2017 |
| EP | 2814112 | A1 | 12/2014 |
| ES | 2608580 | T3 | 4/2017 |
| JP | 2006191379 | A | 7/2006 |

OTHER PUBLICATIONS

PCT International Search Report and Written Opinion issued in International Application No. PCT/CN2019/081912 dated Jul. 10, 2019, 13 pages (with English translation).

Wang et al., "Full-Wave Modeling of Electric Coupling Probes in Comb-Line Resonators and Filters.," IEEE Transactions on Microwave Theory and Techniques, Dec. 2000, 48(12):2459-2464.

Extended European Search Report in European Application No. 19810415.0, dated May 21, 2021, 10 pages.

* cited by examiner

COUPLING STRUCTURE OF FILTER AND PROCESSING METHOD

CROSS-REFERENCE TO RELATED APPLICATIONS

This application is a continuation of International Application No. PCT/CN2019/081912, filed on Apr. 9, 2019, which claims priority to Chinese Patent Application No. 201810533082.4, filed on May 29, 2018. The disclosures of the aforementioned applications are hereby incorporated by reference in their entireties.

TECHNICAL FIELD

This application relates to the mechanical field, and in particular, to a coupling structure of a filter, and a processing method.

BACKGROUND

With the rapid development of wireless communication, hardware competition of communications devices becomes increasingly fierce, and cost control becomes increasingly important. However, a filter occupies a relatively large portion of costs in wireless communication. Die-casting in a cost-effective delivery for a current filter usually has been implemented in a scenario with a large demand, where die costs are apportioned through the large demand. As shown in FIG. 1, the filter includes at least two adjacent cavities 11 of resonators 12. A coupling window 13 is provided on a separate wall between two adjacent resonant cavities 11. On the cavities, there is a shielding lid 14 assembled with a cylindrical tuning screw 15. After the lid and the cavities are assembled, the tuning screw 15 is in the middle of the coupling window 13, and may move up and down to change coupling strength between two resonators, to compensate for a processing error and implement a spectrum response required by the filter.

However, the structure shown in FIG. 1 is fixed, and in a scenario with a relatively small demand (for example, a scenario with a very large coupling value or a very small coupling value), a die needs to be separately developed. Consequently, costs of apportioning die costs are relatively high. Therefore, how to implement a common die for a die corresponding to a scenario with a large demand and a die corresponding to a scenario with a small demand is a problem urgent to be resolved.

SUMMARY

Embodiments of this application provide a coupling structure of a filter, and a processing method, to reduce delivery costs of the filter.

According to a first aspect, an embodiment of this application provides a coupling structure of a filter, where the coupling structure of the filter includes at least two resonant cavities, the resonant cavity is an internal space surrounded by a resonant cavity wall, a resonant cavity bottom plate, and a resonant cavity lid, the at least two resonant cavities are sequentially connected, each of the at least two resonant cavities includes one resonator, and there is a coupling rib assembly between every two of the at least two resonant cavities, where the coupling rib assembly includes a first coupling rib and a second coupling rib, the first coupling rib is connected to the resonant cavity wall and the resonant cavity bottom plate to block two adjacent resonant cavities from each other, and the second coupling rib is connected to the resonant cavity bottom plate, and intersects with the first coupling rib.

In this embodiment of this application, the coupling rib assembly in the coupling structure of the filter is a processable assembly. Therefore, in different scenario demands, a die no longer needs to be separately developed, and it only needs to process the coupling rib assembly again based on an original die, thereby reducing die development costs. In this way, a common die demand in a scenario with a large demand and a scenario with a small demand is implemented, and delivery costs of the filter are reduced.

Optionally, the first coupling rib intersects with the second coupling rib in a cross shape. In this way, a coupling value can be better adjusted.

Optionally, the cavity lid includes a tuning screw. In this way, the coupling value can be fine-tuned, so that processing precision of the coupling structure of the filter is reduced, and a reject ratio of products is reduced.

Optionally, the filter is a coaxial cavity filter.

Optionally, a material of the coupling structure of the filter is metal.

According to a second aspect, an embodiment of this application provides a processing method for a coupling structure of a filter, including:

In this embodiment of this application, the coupling structure of the filter includes two resonant cavities, the resonant cavity is an internal space surrounded by a resonant cavity wall, a resonant cavity bottom plate, and a resonant cavity lid, the two resonant cavities are sequentially connected, each of the two resonant cavities includes one resonator, and there is a coupling rib assembly between the two resonant cavities, where the coupling rib assembly includes a first coupling rib and a second coupling rib, the first coupling rib is connected to the resonant cavity wall and the resonant cavity bottom plate to block the two resonant cavities from each other, and the second coupling rib is connected to the resonant cavity bottom plate, and intersects with the first coupling rib. Based on the structure, when processing the coupling structure of the filter, a processing apparatus needs to first obtain processing parameters of the coupling rib assembly, where the processing parameters include a processing manner and a processing height of the coupling rib assembly, the processing parameters are determined based on a coupling value between the resonators in the two resonant cavities that are in the coupling structure of the filter. Then, the processing apparatus processes the coupling rib assembly based on the processing manner and the processing height of the coupling rib assembly, to generate a coupling structure of a target filter.

It may be understood that, because the first coupling rib blocks the two resonant cavities from each other, the first coupling rib is configured to reduce the coupling value between the resonant cavities; because the second coupling rib is connected to the two resonant cavities, the second coupling rib is configured to enhance the coupling value between the resonant cavities.

In this embodiment of this application, the processing manner and the processing height of the coupling rib assembly are determined in the coupling structure of the filter based on an actual coupling value requirement. The coupling rib assembly is then processed based on the processing manner and the processing height, to determine the coupling structure that is of the target filter and that finally meets the coupling value. In a whole processing process, a die no longer needs to be separately developed, and it only needs to process the coupling rib assembly again based on an original die, thereby reducing die development costs. In this way, a common die demand in a scenario with a large demand and a scenario with a small demand is implemented, and delivery costs of the filter are reduced.

Optionally, a specific manner of processing the coupling rib assembly based on the actual coupling value requirement is as follows.

In a possible implementation, when the coupling value is within a first preset range (that is, when the coupling value is relatively large), the processing manner is removing the first coupling rib through milling, and the processing height is a height value of the second coupling rib. To be specific, a specific execution step of the processing apparatus is: removing the first coupling rib through milling, and then processing the second coupling rib based on the height value of the second coupling rib to generate the coupling structure of the target filter. In this way, the first coupling rib that can reduce the coupling value is removed, and only the second coupling rib that can enhance the coupling value is reserved, so that the coupling value can be effectively increased.

In another possible implementation, when the coupling value is within a second preset range (that is, when the coupling value is relatively small), the processing manner is removing the second coupling rib through milling, and the processing height is a height value of the first coupling rib. To be specific, a specific execution step of the processing apparatus is: removing the second coupling rib through milling, and then processing the first coupling rib based on the height value of the first coupling rib to generate the coupling structure of the target filter. In this way, the second coupling rib that can enhance the coupling value is removed, and only the first coupling rib that can reduce the coupling value is reserved, so that the coupling value can be effectively reduced.

In another possible implementation, when the coupling value is within a third preset range (that is, when the coupling value is within a normal range), the processing manner is reserving the first coupling rib and the second coupling rib, and the processing height is a height value of the first coupling rib and a height value of the second coupling rib. To be specific, a specific execution step of the processing apparatus is: processing the first coupling rib based on the height value of the first coupling rib, and processing the second coupling rib based on the height value of the second coupling rib, to generate the coupling structure of the target filter. In this way, the first coupling rib and the second coupling rib are reserved, so that the coupling value of the resonant cavities can be fine-tuned more effectively.

According to a third aspect, an embodiment of this application provides a coupling structure of a filter, where the coupling structure of the filter includes two resonant cavities, the resonant cavity is an internal space surrounded by a resonant cavity wall, a resonant cavity bottom plate, and a resonant cavity lid, the two resonant cavities are sequentially connected, each of the two resonant cavities includes one resonator, and there is a coupling rib assembly on the resonant cavity lid, where the coupling rib assembly includes a first coupling rib and a second coupling rib, the first coupling rib is connected to an inner wall of the resonant cavity lid, the second coupling rib is connected to the inner wall of the resonant cavity lid, the first coupling rib intersects with the second coupling rib, and the first coupling rib is configured to block the two resonant cavities from each other.

It may be understood that, in the structure, the coupling structure of the filter may alternatively be processed by using the solution in the second aspect, to generate a coupling structure of a target filter. A specific manner is not described herein again.

It can be learned from the foregoing technical solutions that the embodiments of this application have the following advantages: The coupling rib assembly in the coupling structure of the filter is the processable assembly. Therefore, in the different scenario demands, the die no longer needs to be separately developed, and it only needs to process the coupling rib assembly again based on the original die, thereby reducing the die development costs. In this way, the common die demand in the scenario with the large demand and the scenario with the small demand is implemented, and the delivery costs of the filter are reduced.

DESCRIPTION OF EMBODIMENTS

Embodiments of this application provide a coupling structure of a filter, and a processing method, to reduce delivery costs of the filter.

In the specification, claims, and accompanying drawings of this application, the terms "first", "second", "third", "fourth", and so on (if existent) are intended to distinguish between similar objects but do not necessarily indicate a specific order or sequence. It should be understood that the data termed in such a way are interchangeable in proper circumstances so that the embodiments of the present invention described herein can be implemented in other orders than the order illustrated or described herein. Moreover, the terms "include", "contain" and any other variants mean to cover the non-exclusive inclusion, for example, a process, method, system, product, or device that includes a list of steps or units is not necessarily limited to those steps or units expressly listed, but may include other units not expressly listed or inherent to such a process, method, system, product, or device.

The following first describes the coupling structure of the filter that is in the embodiments of this application by using an example. It may be understood that the coupling structure of the filter in the embodiments of this application is not only applicable to a metal coaxial cavity filter in the embodiments of this application, but also applicable to a transverse electric (Transverse Electric, TE) mode dielectric filter and a transverse magnetic (Transverse Magnetic, TM) mode dielectric filter. A specific case is not limited herein.

Figure 1:
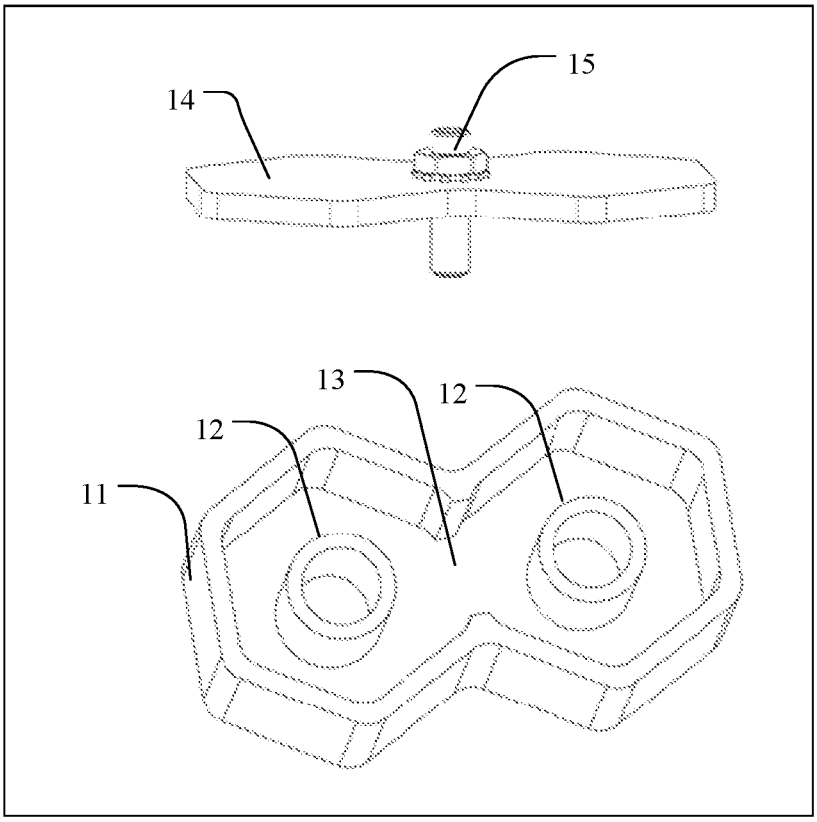
FIG. 1 shows a coupling structure of a filter in a conventional technology.
Figure 2:
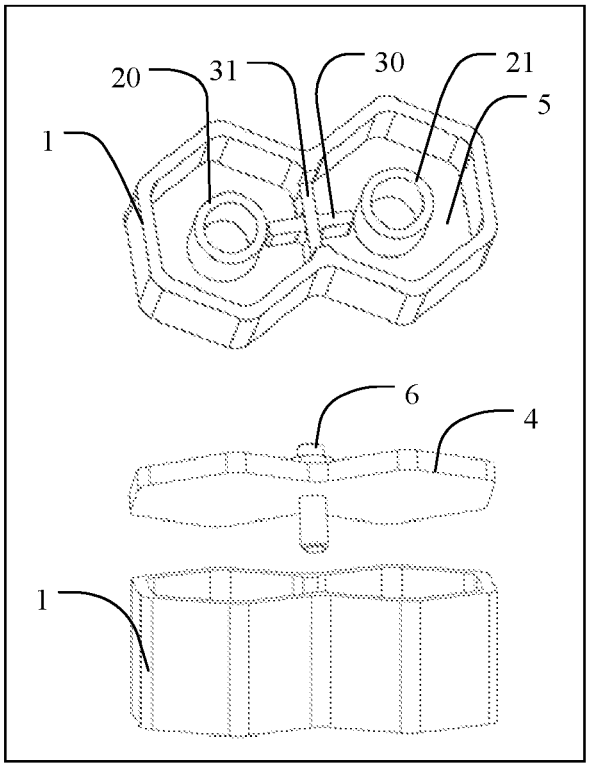
FIG. 2 is a schematic structural diagram of a coupling structure of a filter according to an embodiment of this application.

First, the coupling structure of the filter is described with reference to FIG. 2. The coupling structure of the filter includes at least two resonant cavities. The resonant cavity is an internal space surrounded by a resonant cavity wall 1, a resonant cavity bottom plate 5, and a resonant cavity lid 4. Each resonant cavity includes one resonator. As shown in FIG. 2, the coupling structure of the filter includes two resonant cavities, and the resonant cavities respectively include a resonator 20 and a resonator 21. There is a coupling rib assembly between the resonator 20 and the resonator 21, and the coupling rib assembly includes a first coupling rib 31 and a second coupling rib 30. The first coupling rib 31 is connected to the resonant cavity wall 1 and the resonant cavity bottom plate 5 to block two adjacent resonant cavities from each other. The second coupling rib 30 intersects with the first coupling rib 31, and the second coupling rib is connected to the resonant cavity bottom plate 5.

In this embodiment, the first coupling rib 31 blocks a coupling window between the resonator 20 and the resonator 21. Therefore, the first coupling rib 31 may also be referred to as a reducing coupling rib. The second coupling rib 30 penetrates the resonant cavities to which the resonator 20 and the resonator 21 belong. Therefore, the second coupling rib 30 may also be referred to as an enhancing coupling rib.

It should be understood that FIG. 2 is merely an example description of the coupling structure of the filter, and the coupling structure of the filter may alternatively be a repeating structure of the structure in FIG. 2. This is not specifically limited herein.

Specifically, the second coupling rib 30 may be directly connected to the resonator 20 and the resonator 21, or may not be connected to the resonator 20 and the resonator 21. A specific case is not limited herein. The coupling structure of the filter may be a metal coaxial cavity, or may be of another shape or material. This is not specifically limited herein.

Optionally, the resonant cavity lid 4 of the coupling structure of the filter may further include a tuning screw 6. In this way, an error rate may be allowed when the coupling structure of the filter is processed, thereby improving a qualification rate of products.

Figure 3:
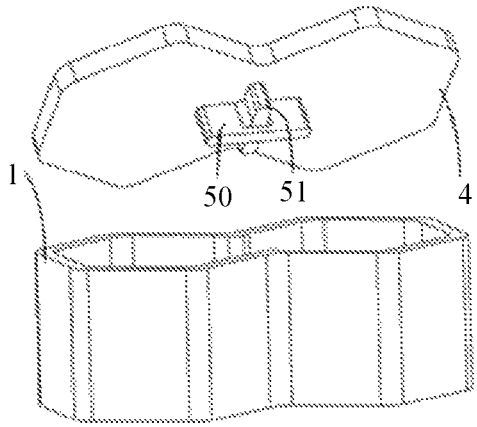
FIG. 3 is another schematic structural diagram of a coupling structure of a filter according to an embodiment of this application.

Optionally, the coupling rib assembly may be further connected to the resonant cavity lid. As shown in FIG. 3, the first coupling rib 51 is connected to the resonant cavity lid, the second coupling rib 50 is connected to the resonant cavity lid, and the first coupling rib 51 intersects with the second coupling rib 50. It may be understood that the first coupling rib 51 may intersect with the second coupling rib 50 in a cross shape.

The foregoing describes the coupling structure of the filter that is in the embodiments of this application, and the following describes a processing method for the coupling structure of the filter.

Figure 4:
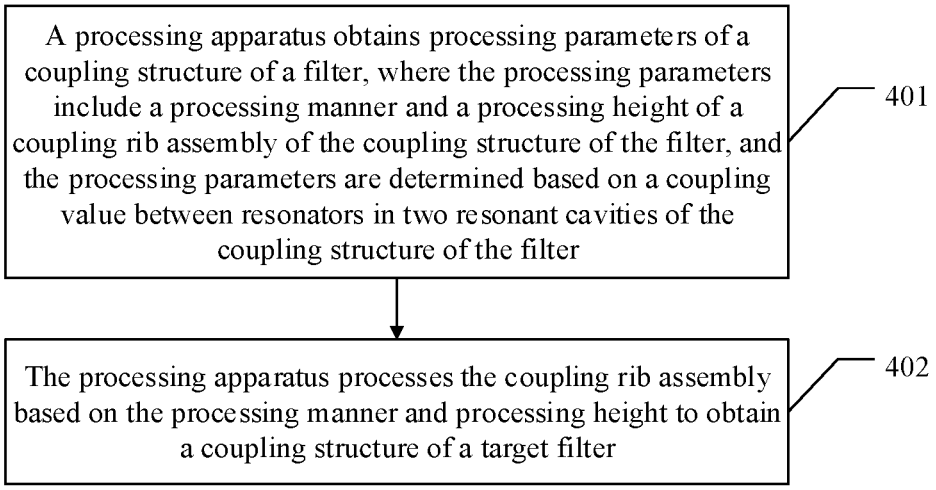
FIG. 4 is a schematic diagram of a processing method for a coupling structure of a filter according to an embodiment of this application.

Referring to FIG. 4, in an embodiment of the processing method for the coupling structure of the filter, the following steps are included.

401. A processing apparatus obtains processing parameters of the coupling structure of the filter, where the processing parameters include a processing manner and a processing height of a coupling rib assembly of the coupling structure of the filter, and the processing parameters are determined based on a coupling value between resonators in two resonant cavities of the coupling structure of the filter.

Because the coupling structure of the filter is mainly determined based on the coupling value, before processing the coupling structure of the filter, the processing apparatus determines processing parameters of the coupling structure of the target filter. It may be understood that a user may first determine a coupling value of the coupling structure of the target filter, and then determine the processing parameters based on a relationship between height values of the coupling rib assembly and the coupling value.

Optionally, the processing apparatus may directly obtain the processing parameters. Alternatively, after obtaining the coupling value that is of the coupling structure of the target filter and that is entered by the user, the processing apparatus may determine the processing height and the processing manner of the coupling rib assembly according to a prestored relationship table, where the relationship table is used to indicate a correspondence between the coupling value and the height values of the coupling rib assembly and a correspondence between the coupling value and the processing manner of the coupling rib assembly. A specific manner is not limited herein.

It should be understood that the processing apparatus may be a machine such as a milling machine or a lathe, for mechanical processing, or may be another machine for die processing. A specific manner is not limited herein.

Through actual verification, the relationship between the coupling value and the coupling rib assembly is specifically as follows.

Figure 5:
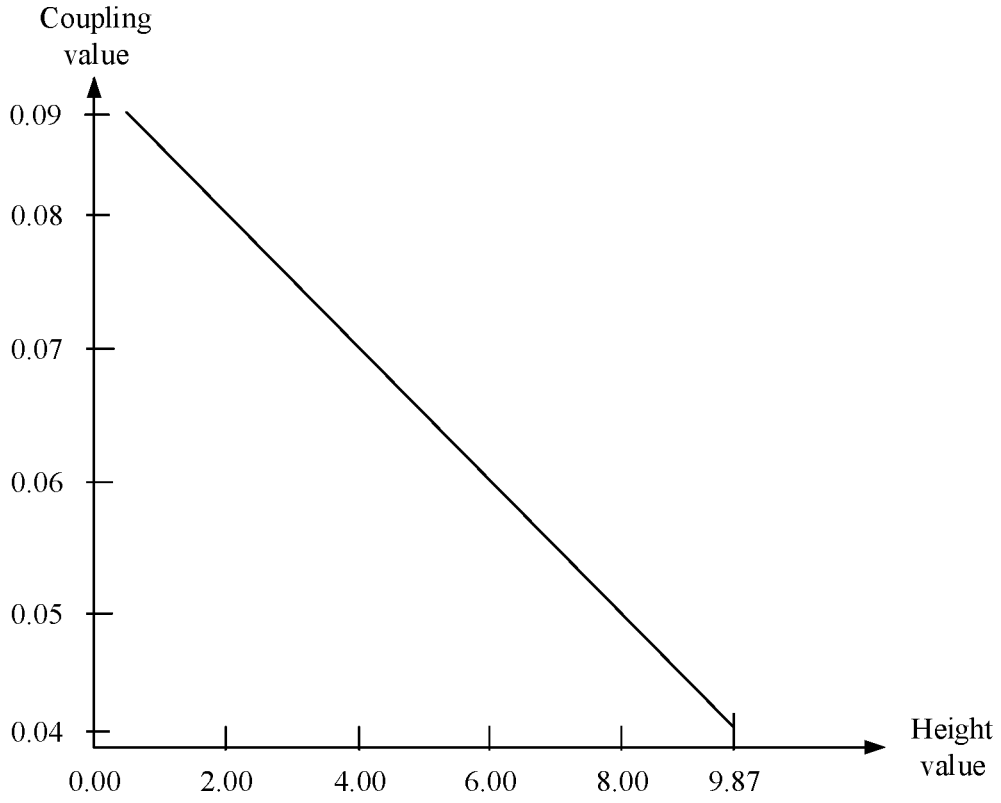
FIG. 5 is a diagram of a linear relationship between a height value of a first coupling rib and a coupling value according to an embodiment of this application.

FIG. 5 is a diagram of a linear relationship between a height value of a first coupling rib and a coupling value. A horizontal axis is the height value of the first coupling rib, and a vertical axis is the corresponding coupling value. It can be learned from FIG. 5 that a larger height value of the first coupling rib indicates a smaller corresponding coupling value.

Figure 6:
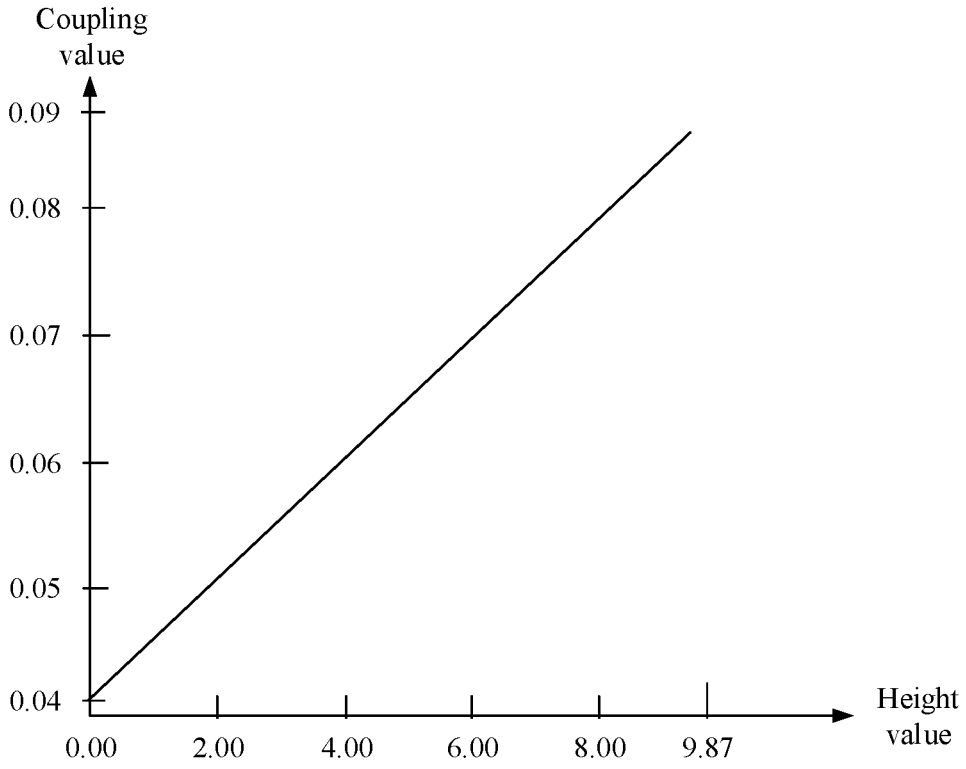
FIG. 6 is a diagram of a linear relationship between a height value of a second coupling rib and a coupling value according to an embodiment of this application.

FIG. 6 is a diagram of a linear relationship between a height value of a second coupling rib and a coupling value. A horizontal axis is the height value of the second coupling rib, and a vertical axis is the corresponding coupling value. It can be learned from FIG. 6 that a larger height value of the second coupling rib indicates a larger corresponding coupling value.

In actual application, a relationship between the coupling value and a processing manner may be specifically as follows.

When the coupling value is within a first preset range, the processing manner is removing the first coupling rib through milling and adjusting the height value of the second coupling rib. When the coupling value is within a second preset range, the processing manner is removing the second coupling rib through milling and adjusting the height value of the first coupling rib. When the coupling value is within a third preset range, the processing manner is adjusting the height values of the first coupling rib and the second coupling rib.

It should be understood that, because the first coupling rib is a reducing coupling rib, and the second coupling rib is an enhancing coupling rib, a value of the coupling value within the first preset range is greater than a value of the coupling value within the third preset range, which is greater than a value of the coupling value within the second preset range. For example, the first preset range is [0.08, 1], the third preset range is [0.05, 0.08], and the second preset range is [0.01, 0.05]. This is merely a possible example, and a specific manner is not limited herein.

402. The processing apparatus processes the coupling rib assembly based on the processing manner and the processing height to generate the coupling structure of the target filter.

The processing apparatus processes the coupling structure of the original filter based on the processing parameters to obtain the coupling structure of the target filter.

A specific case may be as follows.

Figure 7:
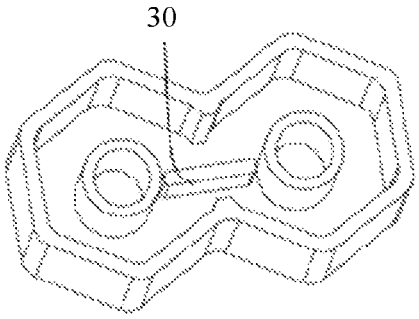
FIG. 7 is a schematic structural diagram of a processed coupling structure of a filter according to an embodiment of this application.

In a possible implementation, when the processing apparatus removes the first coupling rib through milling and processes the second coupling rib based on the height value of the second coupling rib, the coupling structure of the target filter may be shown in FIG. 7. A coupling rib assembly in the coupling structure of the target filter includes only a second coupling rib 30.

Figure 8:
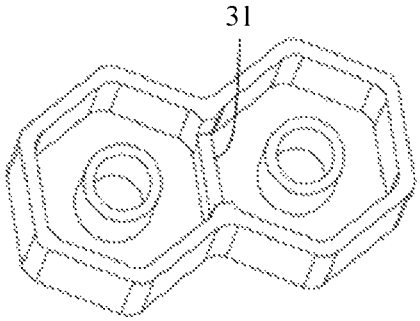
FIG. 8 is another schematic structural diagram of a processed coupling structure of a filter according to an embodiment of this application.

In another possible implementation, when the processing apparatus removes the second coupling rib through milling and processes the first coupling rib based on the height value of the first coupling rib, the coupling structure of the target filter may be shown in FIG. 8. A coupling rib assembly in the coupling structure of the target filter includes only a first coupling rib 31.

In another possible implementation, the processing apparatus processes the first coupling rib based on the height value of the first coupling rib, and processes the second coupling rib based on the height value of the second coupling rib. That is, the coupling structure of the target filter is shown in FIG. 2. A coupling rib assembly in the coupling structure of the target filter includes the first coupling rib and the second coupling rib.

In this embodiment, for different filter bandwidth scenarios, the processing manner and the processing height of the coupling rib assembly may be determined in the coupling structure of the filter based on an actual coupling value. The coupling rib assembly is then processed based on the processing manner and the processing height, to determine the coupling structure that is of the target filter and that finally meets the coupling value. In a whole processing process, a die no longer needs to be separately developed, and it only needs to process the coupling rib assembly again based on an original die, thereby reducing die development costs. In this way, a common die demand in a scenario with a large demand and a scenario with a small demand is implemented, and delivery costs of the filter are reduced.

It may be clearly understood by persons skilled in the art that, for the purpose of convenient and brief description, for a detailed working process of the foregoing system, apparatus, and unit, refer to a corresponding process in the foregoing method embodiments, and details are not described herein again.

In the several embodiments provided in this application, it should be understood that the disclosed system, apparatus, and method may be implemented in other manners. For example, the described apparatus embodiment is merely an example. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected based on actual requirements to achieve the objectives of the solutions of the embodiments.

In addition, function units in the embodiments of this application may be integrated into one processing unit, or each of the units may exist alone physically, or two or more units are integrated into one unit. The integrated unit may be implemented in a form of hardware, or may be implemented in a form of a software function unit.

When implemented in the form of a software function unit and sold or used as an independent product, the integrated unit may be stored in a computer-readable storage medium. Based on such an understanding, the technical solutions of the embodiments of this application essentially, or the part contributing to the prior art, or all or some of the technical solutions may be implemented in the form of a software product. The computer software product is stored in a storage medium and includes several instructions for instructing a computer device (which may be a personal computer, a server, a network device, or the like) to perform all or some of the steps of the method described in the embodiments of this application. The foregoing storage medium includes: any medium that can store program code, such as a USB flash drive, a removable hard disk, a read-only memory (Read-Only Memory, ROM), a random access memory (Random Access Memory, RAM), a magnetic disk, or an optical disc.

The foregoing embodiments are merely intended for describing the technical solutions of this application, but not for limiting this application. Although this application is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of this application.

What is claimed is:

1. A coupling structure of a filter, wherein the coupling structure of the filter comprises at least two resonant cavities, wherein each resonant cavity of the at least two resonant cavities includes an internal space surrounded by a resonant cavity wall, a resonant cavity bottom plate, and a resonant cavity lid, wherein the at least two resonant cavities are sequentially connected, wherein each resonant cavity of the at least two resonant cavities comprises one resonator, wherein a coupling rib assembly is between every two resonant cavities of the at least two resonant cavities, wherein the coupling rib assembly comprises a first coupling rib and a second coupling rib, wherein the first coupling rib is connected to the resonant cavity wall and the resonant cavity bottom plate to block two adjacent resonant cavities from each other, and wherein the second coupling rib is connected to the resonant cavity bottom plate and intersects with the first coupling rib.

2. The coupling structure of the filter according to claim 1, wherein the first coupling rib intersects with the second coupling rib in a cross shape.

3. The coupling structure of the filter according to claim 1, wherein the resonant cavity lid comprises a tuning screw.

4. The coupling structure of the filter according to claim 1, wherein the filter is a coaxial cavity filter.

5. The coupling structure of the filter according to claim 1, wherein a material of the coupling structure of the filter is metal.

6. A processing method of a coupling structure of a filter, applied to the coupling structure of the filter, wherein the coupling structure of the filter comprises two resonant cavities, wherein each resonant cavity of the two resonant cavities includes an internal space surrounded by a resonant cavity wall, a resonant cavity bottom plate, and a resonant cavity lid, wherein the two resonant cavities are sequentially connected, wherein each resonant cavity of the two resonant cavities comprises one resonator, wherein a coupling rib assembly is between the two resonant cavities, wherein the coupling rib assembly comprises a first coupling rib and a second coupling rib, wherein the first coupling rib is connected to the resonant cavity wall and the resonant cavity bottom plate to block the two resonant cavities from each other, wherein the second coupling rib is connected to the resonant cavity bottom plate and intersects with the first coupling rib, and wherein the method comprises:

obtaining processing parameters of the coupling rib assembly, wherein the processing parameters comprise a processing height and a processing manner of the coupling rib assembly, and wherein the processing parameters are determined based on a coupling value between the resonators; and processing the coupling rib assembly based on the processing manner and the processing height to obtain a coupling structure of a target filter.

7. The method according to claim 6, wherein when the coupling value is within a first preset range, the processing manner is removing the first coupling rib through milling, and the processing height is a height value of the second coupling rib; and wherein processing the coupling rib assembly based on the processing manner and the processing height to obtain the coupling structure of the target filter comprises:

removing the first coupling rib through milling, and processing the second coupling rib based on the height value of the second coupling rib to obtain the coupling structure of the target filter.

8. The method according to claim 6, wherein when the coupling value is within a second preset range, the processing manner is removing the second coupling rib through milling, and the processing height is a height value of the first coupling rib; and wherein processing the coupling rib assembly based on the processing manner and the processing height to obtain the coupling structure of the target filter comprises:

removing the second coupling rib through milling, and processing the first coupling rib based on the height value of the first coupling rib to obtain the coupling structure of the filter.

9. The method according to claim 6, wherein when the coupling value is within a third preset range, the processing manner is processing the first coupling rib based on a height value of the first coupling rib, and processing the second coupling rib based on a height value of the second coupling rib; and wherein processing the coupling rib assembly based on the processing manner and the processing height to obtain the coupling structure of the target filter comprises:

processing the first coupling rib based on the height value of the first coupling rib, and processing the second coupling rib based on the height value of the second coupling rib to obtain the coupling structure of the filter.

* * * * *